United States Patent [19]

Oku et al.

[11] Patent Number: 4,792,721

[45] Date of Patent: Dec. 20, 1988

[54] CATHODE-RAY TUBE WITH ELECTROSTATIC DEFLECTION

[75] Inventors: Kentaro Oku, Kokubunji; Masanori Maruyama, Tokorozawa; Masakazu Fukushima, Tokyo; Shinichi Kato, Mobara, all of Japan

[73] Assignee: Hitachi, Ltd., Tokyo, Japan

[21] Appl. No.: 39,275

[22] Filed: Apr. 17, 1987

[30] Foreign Application Priority Data

Apr. 18, 1986 [JP] Japan ..... 61-87924

[51] Int. Cl.[4] ..... H01J 29/62; H01J 29/70

[52] U.S. Cl. ..... 313/432; 313/439; 313/450; 315/17

[58] Field of Search ..... 313/432, 439, 450; 315/17

[56] References Cited

U.S. PATENT DOCUMENTS 4,701,668 10/1987 Oku et al. ..... 313/432 X

FOREIGN PATENT DOCUMENTS 60-47351 of 1985 Japan .

60-49542 of 1985 Japan .

*Primary Examiner*—David K. Moore

*Assistant Examiner*—K. Wieder

*Attorney, Agent, or Firm*—Antonelli, Terry & Wands

[57] ABSTRACT

A cathode-ray tube comprises an electron beam generating section provided at one end of the tube, a target provided at the other end of the tube, and a group of electrodes provided on an inner wall of the tube for focusing and deflecting an electron beam. The electrode group includes first and second electrodes between the one and other ends of the tube in the mentioned order. The first electrode has a lead electrode portion for supplying an electric potential to the second electrode. The lead electrode portion extends along the tube axis with a zigzag form in which an angle ∠MZN of a convave apex M and a convex apex N adjacent thereto spanning in a circumferential direction centering the tube axis Z is not smaller than 115° or a spiral form which rotates centering the tube axis at a rotation angle not smaller than 420°.

7 Claims, 14 Drawing Sheets

CATHODE-RAY TUBE WITH ELECTROSTATIC DEFLECTION

BACKGROUND OF THE INVENTION

The present invention relates to a cathode-ray tube, and more particularly, an electrode structure of a cathode-ray tube utilizing an electric field for focusing of an electron beam.

An all-electrostatic camera tube (hereinafter referred toaas SS camera tube) uses an electric field for focus and deflection of an electron beam and is described in, for example, Kakizaki et al, "An All-Electro Static Camera Tube", Technical & Research Report of The Institute of Television Engineers of Japan, No. ED-808, Sept. 28, 1984, pp. 7-pp. 12, JP-A-No. 60-47351 and JP-A-No. 60-49542. The SS camera tube has merits that good characteristics can be achieved with a short tube length, that no coil assembly is required for focus and deflection, and that a power consumption required for focus and deflection of an electron beam is very small. Therefore, the SS camera tube is advantageous to the reduction in size, weight and power consumption of a video camera.

FIG. 2 shows a schematic cross-sectional view of the conventional SS camera tube. An electron beam emitted from an electron gun which is constituted by a triode section including a cathode 201, a first grid 202 and a second grid 203, is focused onto a photoconductive target 208 by the action of an electric field produced by third, fourth and fifth grid electrodes 205, 206 and 207 which are disposed on the inner wall of a glass tube 204. At the same time, the electron beam is deflected by the action of an electric field formed by deflection electrodes as the fourth grid electrodes 206 to scan the photoconductive target 208, thereby reading an image signal. The signal thus obtained is taken out of the glass tube 204 to the outside thereof through a pin 210 which passes through a glass plate 209. A mesh electrode 211 and a ring electrode 212 are connected to the same potential $E_{C6}$(V). An electrostatic lens is formed by a potential difference established between the ring electrode 212 and the fifth grid electrode 207 which is applied with a potential $E_{C5}$(V). This lens is called a collimating lens and has a function of adjusting a landing error of the deflected electron beam in a radial direction. The fifth grid electrode 207 and the mesh electrode 211 are applied with their voltages from the outside of the glass tube 204 via a metal pin 213 passing through the glass tube 204 and via an indium ring 214, respectively. Voltages to the other electrodes are supplied via stem pins 215.

FIG. 3 shows an expanded view of pattern electrodes (including the third to fifth grid electrodes) disposed on the inner wall of the tube. The third grid elecrrode 205 is constituted by leads $H_L+$, $H_L-$, $V_L+$ and $V_L-$ of the deflection electrodes (fourth grid electrode) 206 and an interleaved electrode $G_Q$ applied with a potential $E_{C3}$(V). The fourth grid electrode 206 is constituted by horizontal-deflection electrodes H+ and H− and vertical-deflection electrodes V+ and V−. To the deflection electrodes H+, H−, V+ and V−, bias voltages $E_{C4}$ superimposed with $+V_H/2$, $-V_H/2$, $+V_V/2$ and $-V_V/2$ are applied, respectively. The applied voltages form a deflection electric field. Typical voltages applied to the electrodes are as follows. The voltages of the second grid 203, interleaved electrode $G_Q$, fifth grid electrode 207 and mesh electrode 211 are 105V, 800V, 480V and 800V, respectively. The electron beam is focused onto the target 208 by adjusting the bias voltage $E_{C4}$.

When SS camera tubes are used for high-definition TV cameras for the purpose of providing a high resolution, the resolution in the case of using the conventional SS camera has a limitation due to the aberration of an octupole lens involved, as will be explained in below.

Explanation will now be made of the spherical aberration of an axial-symmetric lens and the aberration of the octupole lens.

FIG. 4 illustrates a distribution of potentials on a circumference A–A' shown in FIG. 3 when no deflection is made. The abscissa of FIG. 4 represents an angle $\theta$ around the tube axis and the ordinate thereof represents a potential $\phi$. The potential $\phi$ can be regarded as one in which a potential changing alternately in positive and negative directions is superimposed on a potential $V_0$ which is an average of the potential $\phi$ in the direction of $\theta$. An axial-symmetric lens is formed by the potentials $V_O$, $E_{C4}$ and $E_{C5}$ and an electron beam is focused onto the target by this lens. One of factors obstructing the focusing of the electron beam when only the axial-symmetric lens exists, is the spherical aberration of the axial-symmetric lens.

The spherical aberration of the axial-symmetric lens is schematically illustrated in FIGS. 5A and 5B. The trajectory 501 of the electron beam emitted with a small divergent angle from a central portion c of the second grid 203 is focused onto a paraxial image plane 520. However, as the divergent angle increases, a point of intersection of the beam trajectory with the tube axis moves toward the second grid 203, as is seen from trajectories 502 and 503 in FIG. 5A. Thus, as is shown in FIG. 5B, the impinging position of electrons on the paraxial image plane concentrically expands as the divergent angle of the electron beam is increased. Such an electron beam has the minimum diameter at a location 521 in front of the paraxial image plane. A circle having the minimum diameter is cllled a disk of least confusion. The above-mentioned phenomenon is called the aberration, especially, spherical aberration of the axial-symmetric lens. The divergent angle of an electron beam in the camera tube is several degrees at largest. With such divergent angles, a third-order spherical aberration is dominant. When only the third-order spherical aberration exits, the divergent angle $\alpha$ of electrons and the radius r of the impinging position of electrons on the paraxial image plane has the following relation:

$$r = MC_s\alpha_3 \quad (1)$$

Here, M is the magnification of image formation of the lens and $C_s$ is the coefficient of the thrrd-order spherical aberration.

An electrostatic lens in the SS camera tube can be regarded a combined lens of an axial-symmetric lens and an octupole lens. The octupole lens is formed by an electric potential changing alternately in positive and negative directions above and below the average potential $V_O$.

FIG. 6 represents an electric field formed by the octupole lens by vectors (or arrows) in a cross section taken along line A—A' of FIG. 3. It is seen from FIG. 6 that the electric field is directed from the interleaved electrode $G_Q$ toward the leads $H_L+$, $H_L-$, $V_L+$ and $V_L-$ of the deflection electrodes so that the octupole lens is formed. It is also seen that the influence of the octupole lens is little in the vicinity of the tube axis but becomes large with approach to the tube wall. Accordingly, the addition of the octupole lens to the axial-symmetric lens results in no change of the paraxial characteristics (including the position of the paraxial image plane and the magnification of the lens) but influences the third-order aberration and gives a $\theta$-direction dependency to the aberration. When electrons are emitted with a divergent angle $\alpha$ from the central portion c of the second grid 203 in the circumferential direction $\theta$, i.e., when the projections $\beta$ and $\gamma$ of the divergent angle of electrons to the x- and y-directions are give by the equations of $$\beta=\alpha \cos \theta \quad (2)$$

and $$\gamma=\alpha \sin \theta \quad (3)$$

the coordinates $x_b$ and $y_b$ of the impinging position of electrons on the paraxial image plane are as follows:

$$x_b=MC_{sx}(\theta)\,\alpha^3 \quad (4)$$

$$y_b=MC_{sy}(\theta)\,\alpha^3 \quad (5)$$

Here, M is the magnification and $C_{sx}(\theta)$ and $C_{sy}(\theta)$ are given by the following equations:

$$C_{sx}(\theta)=a \cos^3 \theta+b \cos^2 \theta \sin \theta+c \cos \theta \sin^2 \theta+d \sin^3 \theta \quad (6)$$

$$C_{sy}(\theta)=-d \cos^3 \theta+c \cos^2 \theta \sin \theta-b \cos \theta \sin^2 \theta+a \sin^3 \theta \quad (7)$$

In the case of an ordinary axial-symmetric lens, the equations of $$a=c=C_s \quad (8)$$

and $$b=d=O \quad (9)$$

are satisfied. Therefore, deviations from the condition equations (8) and (9) can be regarded as influences of the octupole lens.

The present inventors have analyzed the influences by the octupole lens for the conventional SS camera tube shown in FIGS. 2 and 3. The result of the analysis gives the coefficients a, b, c and d of the third-order aberration which are 1.15 ($\mu$m/deg$^3$), 0, −0.75 and 0, respectively. This result significantly deviates from the equations (8) and (9) conditioning the axial-symmetric lens and therefore demonstrates great influence of the octupole lens. FIGS. 7A and 7B show the shapes of beam spots formed on the paraxial image planes. FIG. 7A illustrates the beam spot in the case where an effect of the octupole lens is involved while FIG. 7B illustrates the beam spot in the case where only the axial-symmetric lens exists. In both cases, the divergent angle of an electron beam from the electron gun was 2.2°. From FIGS. 7A and 7B, it is seen that though the shape of the beam is circular when only the axial-symmetric lens exists, the otcupole lens has an effect of expanding the beam like four leaves.

FIGS. 8A and 8B show the shapes of electron beams when a circumscribed circle of the beam becomes to be minimum. In a usual operation, the bias voltage $E_{C4}$ is adjusted so that the minimum circumscribed circle is positioned on the target surface. Therefore, the beam shapes shown in FIGS. 8A and 8B can be regarded as ones when the focusing of the electron beam is optimized. FIG. 8A illustrates the beam shape in the case where the effect of the octupole lens is put into consideration while FIG. 8B illustrates the beam shape in the case where only the axial-symmetric lens exists. Though the beam diameter is 1.8 $\mu$m when only the axial-symmetric lens exists, the beam diameter under the presence of the octupole lens is increased to 5.1 $\mu$m which is about three times of 1.8 $\mu$m. Thus, the conventional SS camera tube has a disadvantage drawback that under the influence of the octupole lens formed by the interleaved electrode $G_Q$ and the lead portions $H_L+$, $H_L-$, $V_L+$ and $V_L-$ of the deflection electrodes, the diameter of the electron beam is increased, thereby deteriorating the resolution. Further, when the defocusing of an electron beam takes place, the beam shape expands like four leaves, thereby resulting in the deterioration of characteristics that the resolution has a dependence on direction. The direction dependency of the resolution means that the resolution of the camera tube, for example, when the image of a black and white pattern consisting of oblique stripes is formed, the resolution changes depending on the tilt angle of the pattern.

As mentioned above, the conventional SS camera ttube has the drawbacks that due to the influence of aberration of the octupole lens, the diameter of an electron beam is increased resulting in the deterioration of resolution and that when the beam defocusing takes place, the dependence on direction is produced in the resolution.

SUMMARY OF THE INVENTION

An object of the present invention is to improve the resolution of an electron beam in an electron beam system of the SS camera tube and to reduce the direction dependency of the resolution when the defocusing of the electron beam takes place.

The above object is achieved by configuring the lead portions of deflection electrodes into a zigzag or spiral form along the tube axis.

By configuring the leads of the deflection electrodes into the zigzag form along the tube axis or rotating the leads spirally along the tube axis, the influence of an octupole lens can be reduced. Thereby it is possible to reduce the aberration of an electron lens to the extent of the aberration produced when only an axial-symmetric lens exists.

DESCRIPTION OF THE PREFERRED EMBODIMENTS

Figure 1:
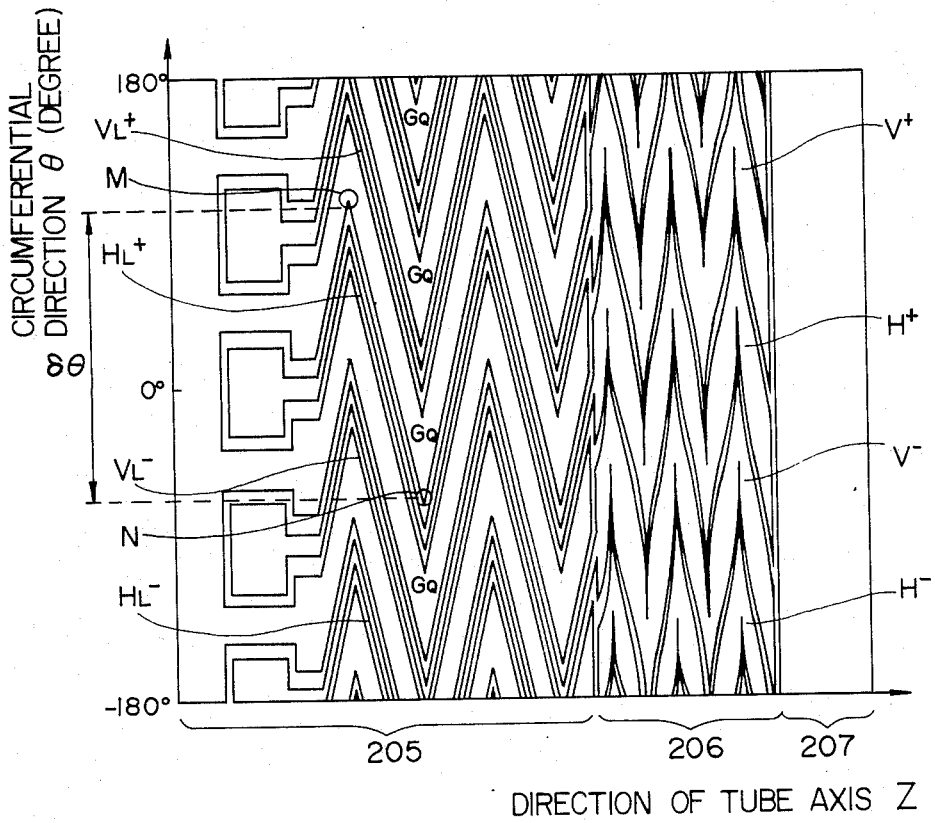
FIG. 1 is an expanded view of pattern electrodes in the SS camera tube according to an embodiment of the present invention.

FIG. 1 shows pattern electrodes of the present invention in an expanded view. An electric field produced by a third grid electrode 205, a fourth grid electrode 206 and a fifth grid electrode 207 focuses an electron beam onto a photoconductive target 208. At the same time, an electric field produced by deflection electrodes ($H^+$, $H^-$, $V^+$, $V^-$) as a fourth electrode 206 deflects the electron beam to sca the target. The third grid electrode 205 is constituted by leads $H_L^+$, $H_L^-$, $V_L^+$ and $V_L^-$ of the deflection electrodes and an electrode $G_Q$ interposed therebetween. According to the present invention, the leads $H_L^+$, $H_L^-$, $V_L^+$ and $V_L^-$ and the electrode $G_Q$ extend along a direction of the tube axis Z in a zigzag form which has apices in a circumferential direction $\theta$ centering the tube axis Z and has a specified zigzag angle $\delta\theta$ defined by an angle $\angle MZN$ of a concave apex M and a convex apex N adjacent thereto streching relative to the tube axis Z as viewed from the side of the electron gun.

Figure 9A:
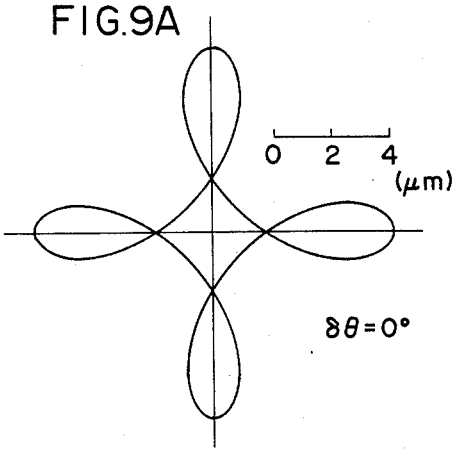
FIGS. 9A to 9G show the shapes of beam spots on the paraxial image plane for various zigzag angles $\delta\theta$ for the SS camera tube whose electrodes are shown in FIG. 1.
Figure 9B:
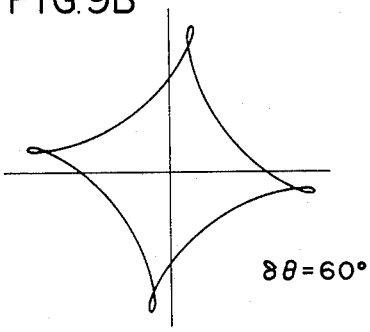
Figure 9C:
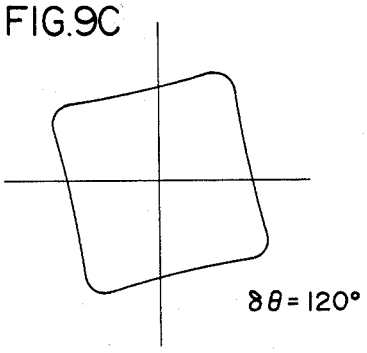
Figure 9D:
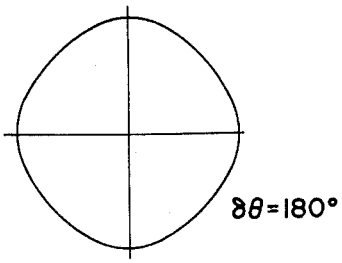
Figure 9E:
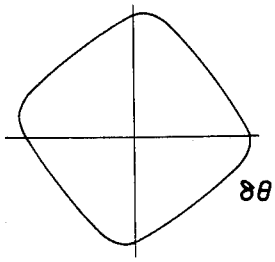
Figure 9F:
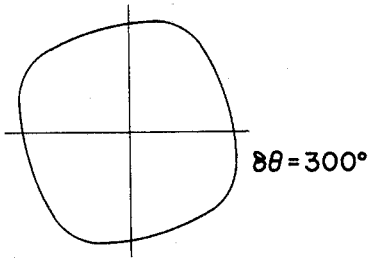
Figure 9G:
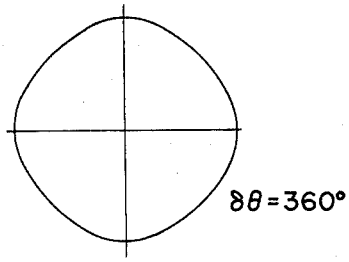

FIGS. 9A to 9B show the shapes of an electron beam on a paraxial image plane for every 60° of the zigzag angle $\delta\theta$ when undeflected. From these figures, it is seen that as the zigzag angle increases, the bemm spot shape has a change of four-leaf shape ($\delta\theta=0°$)→asteroid ($\delta\theta=60°$)→square ($\delta\theta=120°$)→circle ($\delta\theta=180°$)→square ($\delta\theta=240°$)→circle ($\delta\theta=360°$). Accordingly, it will be understood that the zigzag angle in the vicinity of 180° or 360°, it is possible to approximate the beam shape on the paraxial image plane into a circle. The third-order coefficients a, b, c and d in the case of the zigzag angle $\delta\theta$ of 180° are 0.70 ($\mu m/deg^3$), −0.02, 0.63 and 0.01, respectively, and those in the case of the zigzag angle of 360° are 0.69, −0.02, 0.64 and 0.01, respectively. These values substantially satisfy the conditions of the axial-symmetric lens represented by the afore-mentioned equations (8) and (9). The same holds for the case where the zigzag angle $\delta\theta$ is integer times such as 540°, 720°, . . . as large as 180°. This is because if the width of the electrode $G_Q$ in the direction of the tube axis Z is added along a generatrix (i.e. a line on which $\theta$ is constant) of the tube cylinder when the zigzag angle $\delta\theta$ is selected to be integer times as large as 180°, the resulting sum does not depend on the circumferential direction $\theta$ so that an influence of the octupole lens can be reduced to minimum.

Figure 10:
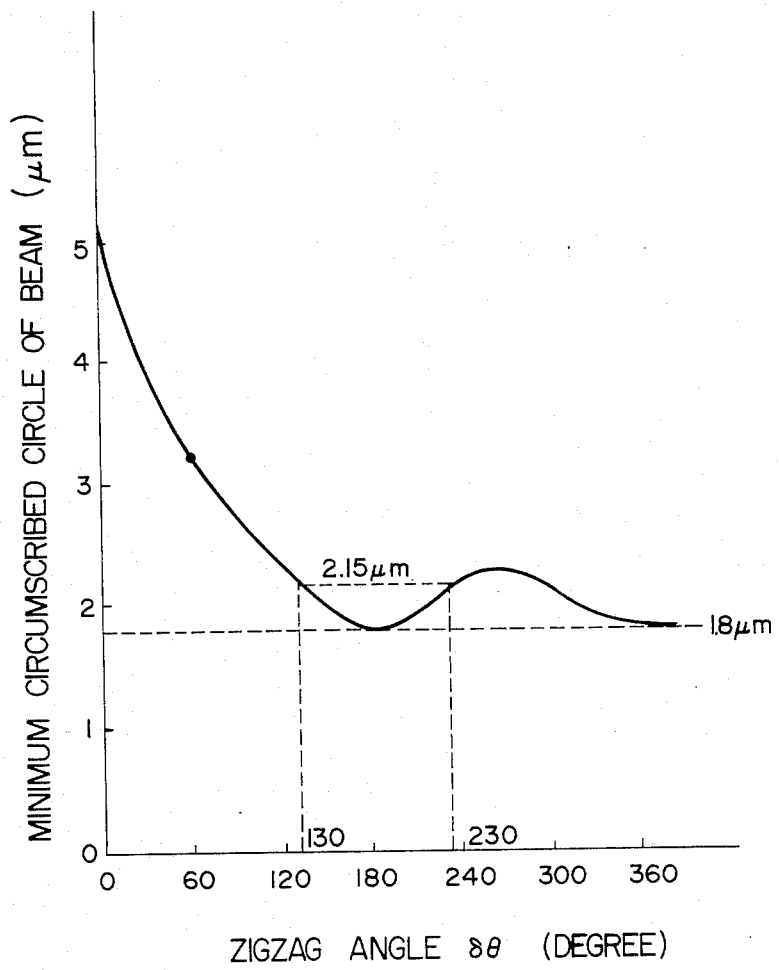
FIG. 10 is a graph showing a relationship between the diameter of the minimum circumscribed circle of the beam and the zigzag angle $\delta\theta$ for the SS camera tube whose electrodes are shown in FIG. 1.

FIG. 10 shows the diameter of a circumscribed circle of an electron beam where the circumscribed circle becomes minimum. It is seen from the figure that as the zigzag angle is applied and increased, the beam diameter, which is 5.1 $\mu m$ at the zigzag angle of 0°, decreases to the minimum value 1.8 $\mu m$ at the zigzag angle of 180°, then increases to the maximum value 2.3 $\mu m$ at the zigzag angle of 270° and thereafter decreases again until the zigzag angle of 360°. The minimum value of 1.8 $\mu m$ is equal to a beam diameter when only the axial-symmetric lens is taken into account. Though not shown in FIG. 10, as the zigzag angle is further increased, the beam diameter takes its minimum value of 1.8 $\mu m$ at the zigzag angle of integer times as large as 180° and gradually approaches 1.8 $\mu m$ with some vibration. By establishing the zigzag angle into the vicinity of integer times of 180° or making the zigzag angle large, therefore, it is possible to reduce an influence of the octupole lens, thereby making the electron beam diameter the smallest. However, as the zigzag angle becomes larger, each apex has a more sharper edge portion so that an electric discharge is easier to take place at the apex portion. Accordingly, the use of a zigzag angle which is as small as possible, is preferable in preventing breakage of the electrodss due to the electric discharge. In order to make the beam diameter small and to prevent the breakage due to the electric discharge, it is preferable to establish the zigzag angle into a value ($\delta\theta=180°$) which corresponds to the first minimum value of the beam diameter. If the increase of 20% from the beam diameter at the zigzag angle of 180° is allowed, the zigzag angle in a range from 130° to 230° is useful.

The above description has been made for the so-called UPF((uni-potential focus) type of SS camera tube in which the cylindrical electrode (fifth grid electrode) 207 is disposed between the deflection electroes and the mesh electrode. The similar can also be said for the so-called BPF (bi-potential focus) type of SS camera tube in which the cylindrical electrode or fifth grid electrode 207 is omitted.

Figure 11:
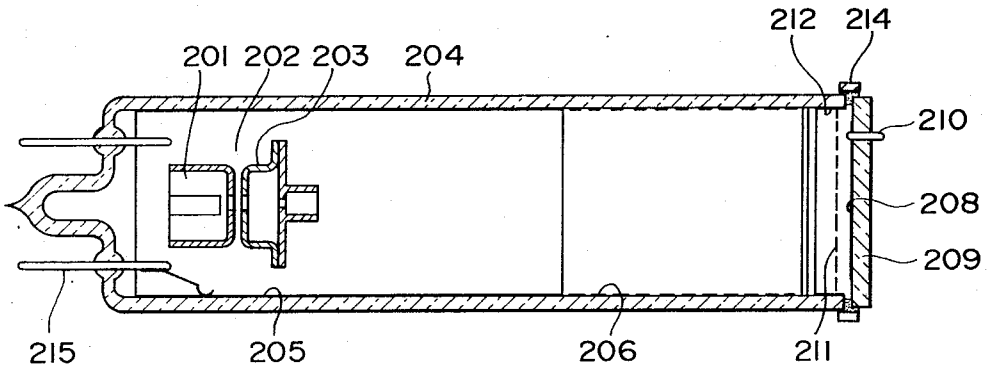
FIG. 11 is a cross-sectional view of a BPF type of the SS camera tube according to another embodiment of the present invention.
Figure 12:
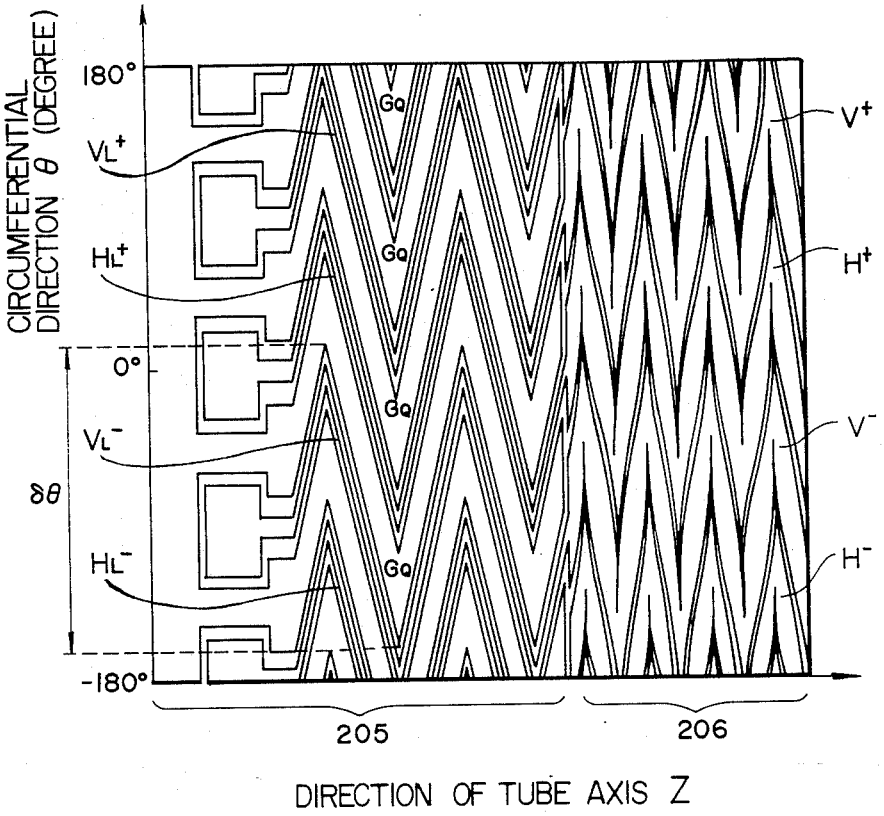
FIG. 12 is an expanded view of pattern electrodes in the SS camera tube shown in FIG. 11.

FIGS. 11 and 12 show another embodiment in which the present invention is applied to the BPF type of SS camera tube. FIG. 11 is a cross-sectional view of the camera tube and FIG. 12 is an expanded view of the third and fourth grid electrodes 205 and 206. In the present embodiment, voltages of the respective electrodes were established as follows. The voltage of the second grid 203 was 105V, the voltage of the electrode $G_Q$ was 600V and the voltage of the mesh electrode 211 was 340V. A bias voltage of the fourth grid electrode 206 used for adjusting the focusing of an electron beam is about several volts.

Figure 13:
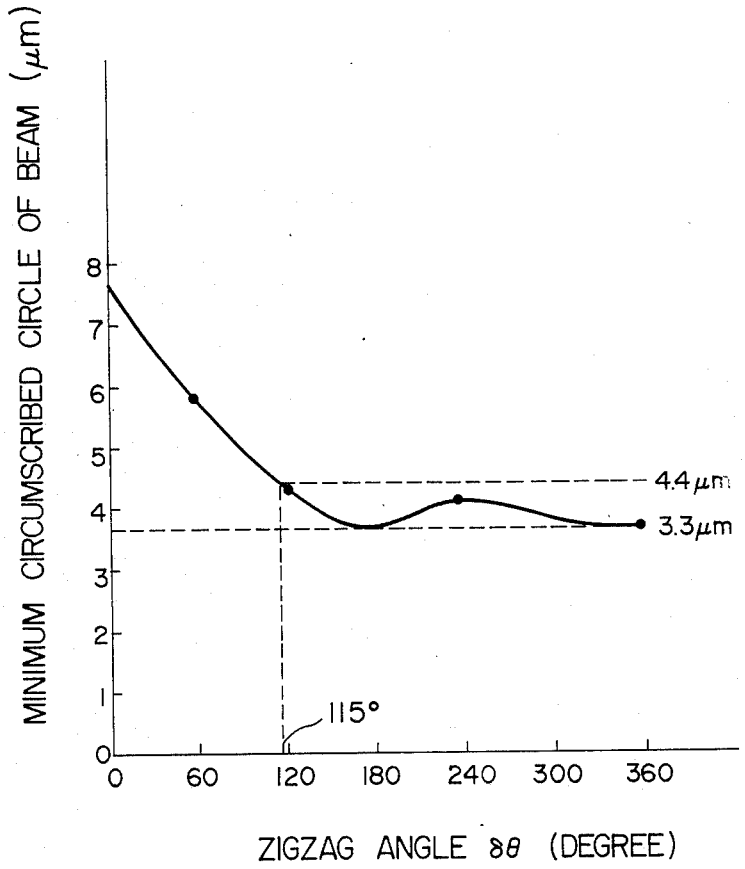
FIG. 13 is a graph showing a relationship between the diameter of the minimum circumscribed circle of the beam and the zigzg angle 68 for the SS camera tube shown in FIGS. 11 and 12.

FIG. 13 is a graph similar to FIG. 10 showing the diameter of the minimum circumscribed circle of an electron beam in the BPF type of SS camera tube shown in FIGS. 11 and 12 when a divergent angle of the beam is 2.2°. In this case, too, the beam diameter has the minimum value at the zigzag angle of 180°. When the increase of the beam diameter to the extent of 20% is allowed, the zigzag angle not smaller than 115° is suitable.

Though in the foregoing embodiments the aberration of the octupole lens has been reduced by configuring the leads of the deflection electrodes into a zigzag form, a similar effect can be also obtained by rotating the deflection electrode leads spirally along the tube axis.

Figure 2:
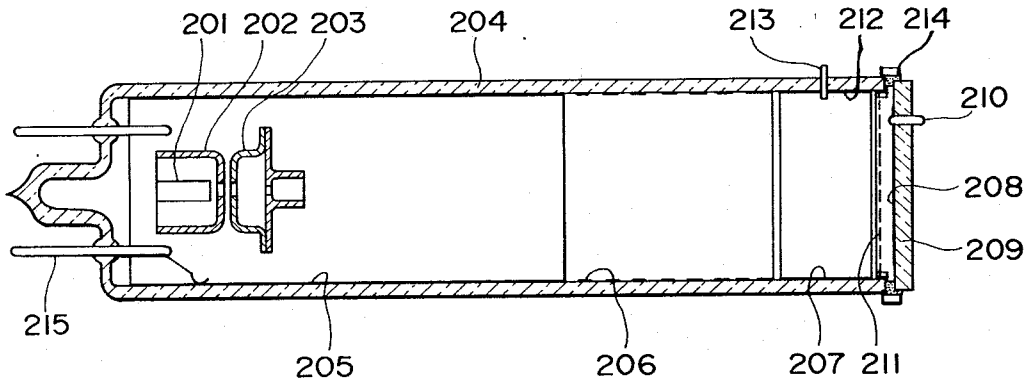
FIG. 2 is a cross-sectional view of a UPF type of SS camera tube.
Figure 3:
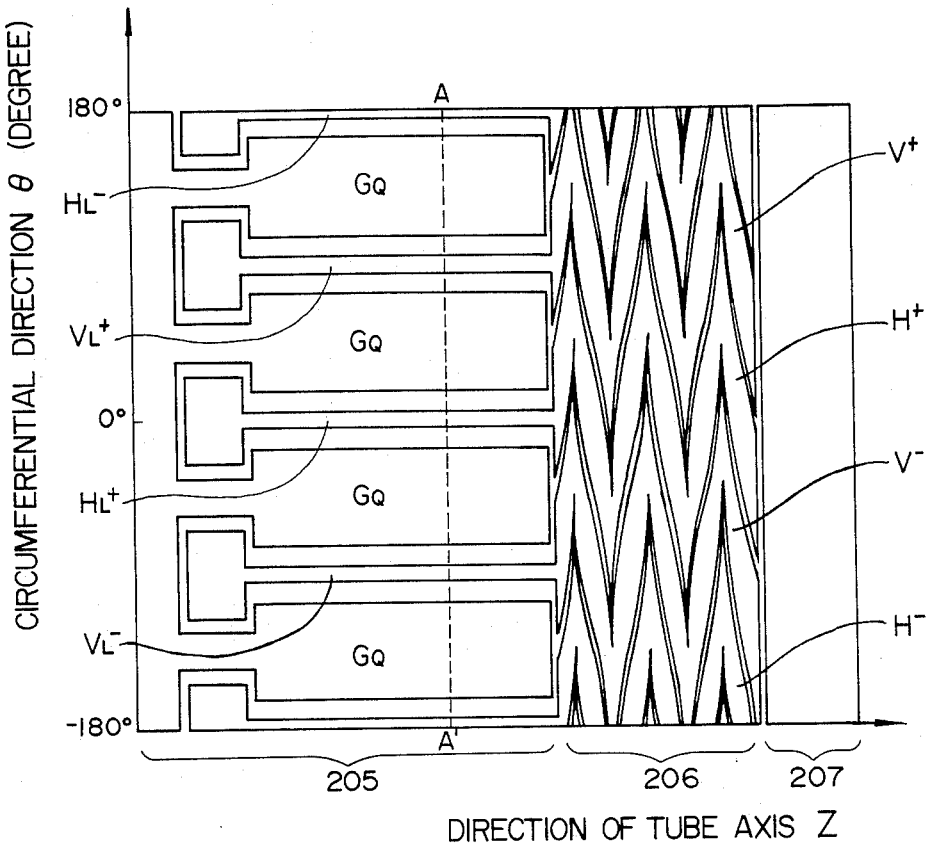
FIG. 3 (PRIOR ART)
FIG. 3 is an expanded view of pattern electrodes in the conventional SS camera tubes.
Figure 4:
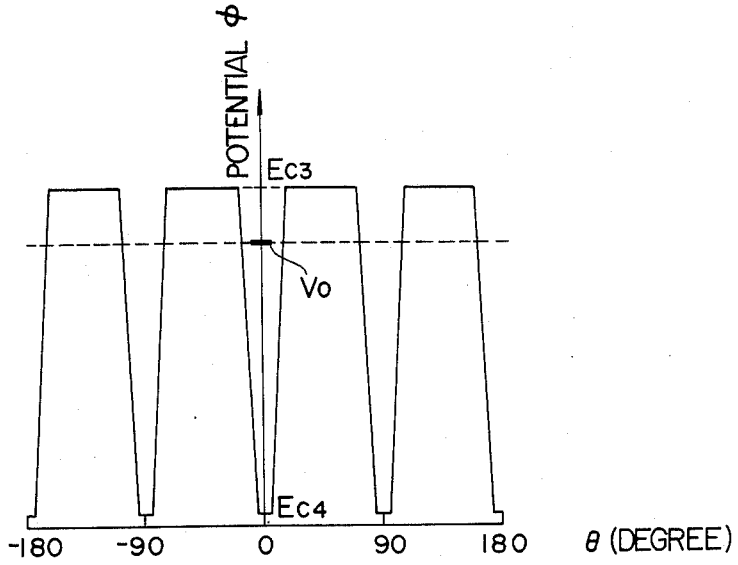
FIG. 4 shows a distribution of potentials along a circumferential direction on the inner wall of the tube on which leads of deflection electrodes and an interleaved electrode are disposed.
Figure 5A:
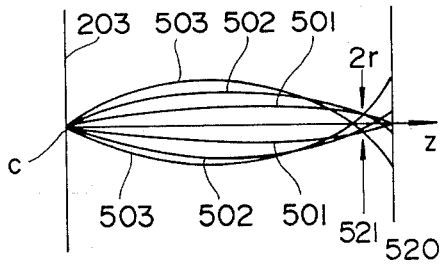
FIGS. 5A and 5B are views useful for explaining the spherical aberration of an axial-symmetric lens.
Figure 5B:
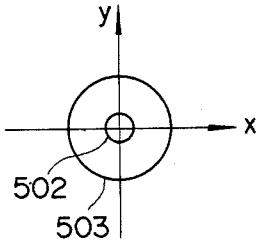
Figure 6:
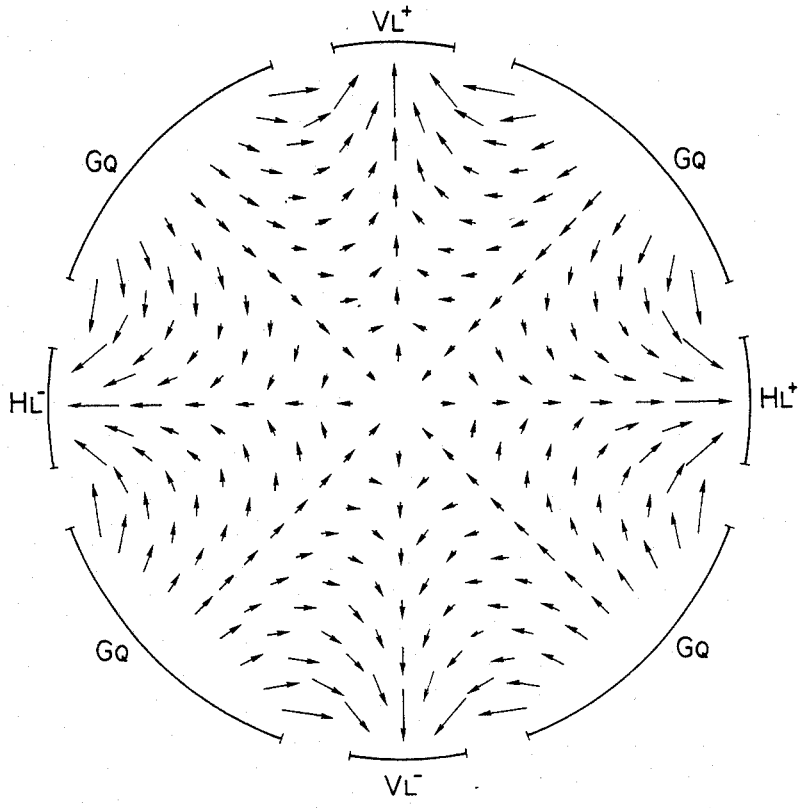
FIG. 6 shows a distribution of electric fields formed by an octupole lens.
Figure 7A:
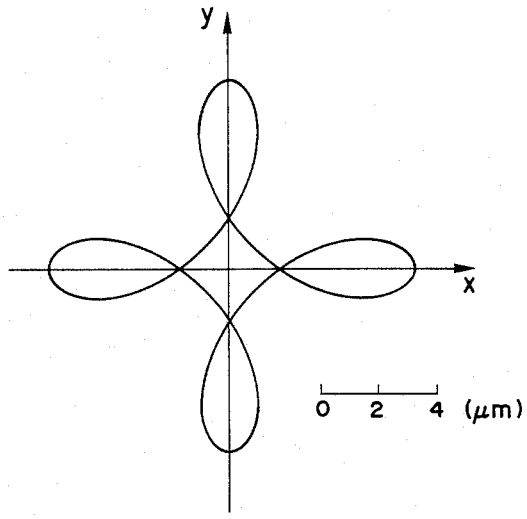
FIGS. 7A and 7B show beam spots formed on paraxial image planes fortthe electron optical system shown in FIG. 3 with and without the influence of the octupole lens, respectively.
Figure 7B:
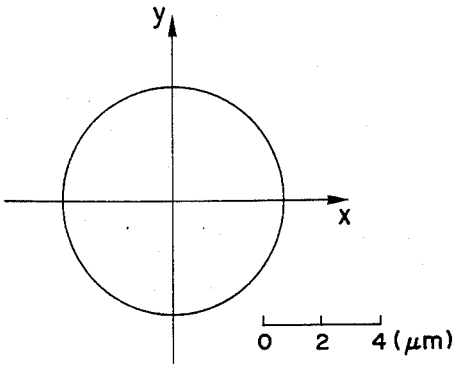
Figure 8A:
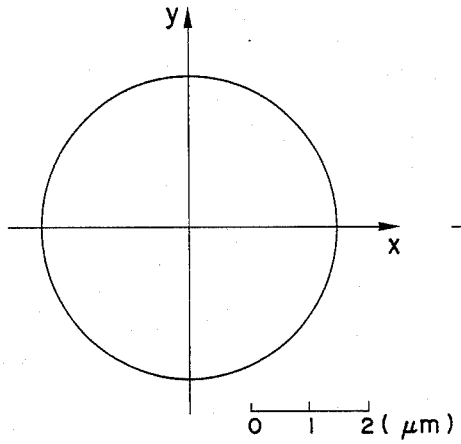
FIGS. 8A and 8B show electron beam spots when a circumscribed circle of the beam becomes minimum for the electron optical system shown in FIG. 3 with and without the influence of the octupole lens, respectively.
Figure 8B:
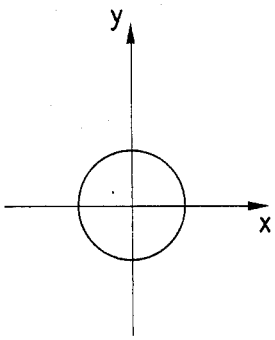
Figure 14:
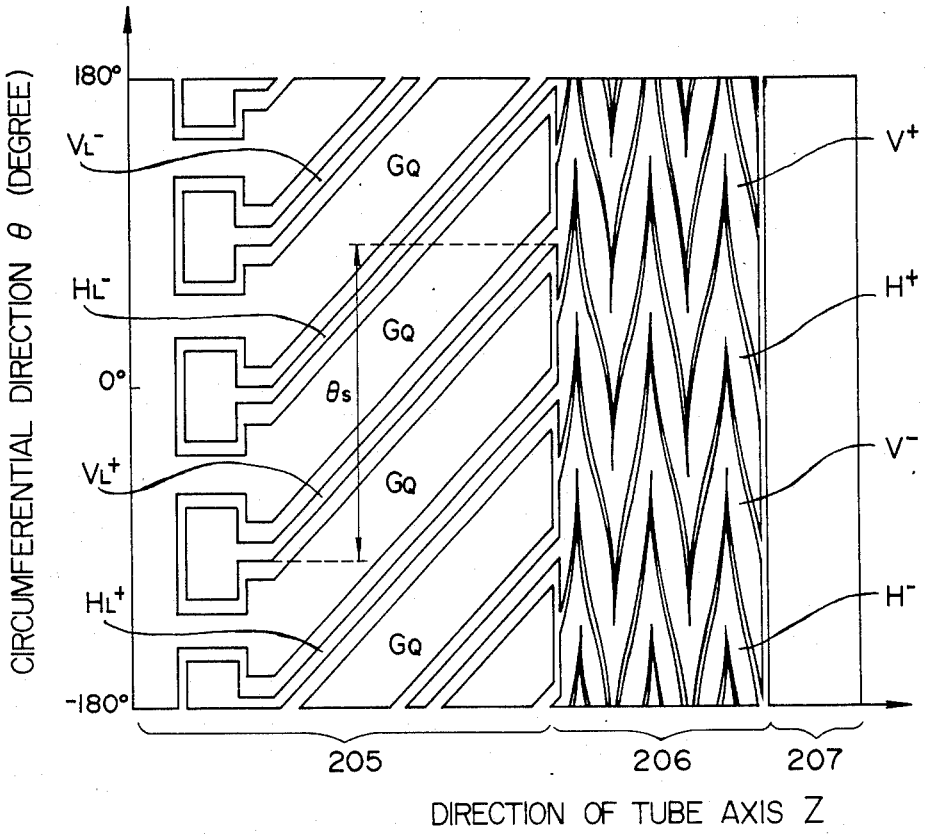
FIG. 14 is an expanded view of pattern electrodes in the SS camera tube according to a further embodiment of the present invention.
Figure 15A:
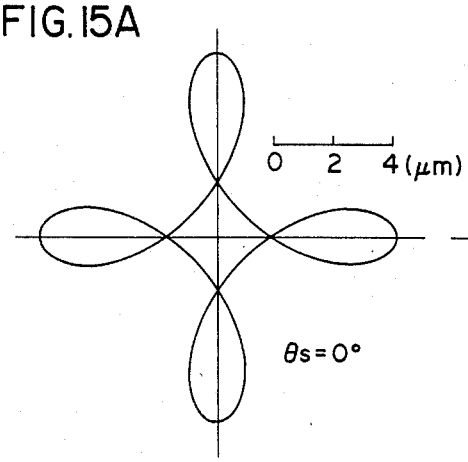
FIGS. 15A to 15E show beam spots formed on paraxial image planes in the embodiment of FIG. 14.
Figure 15D:
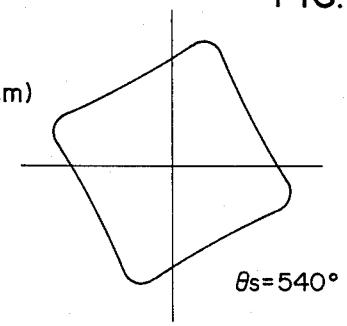
Figure 15B:
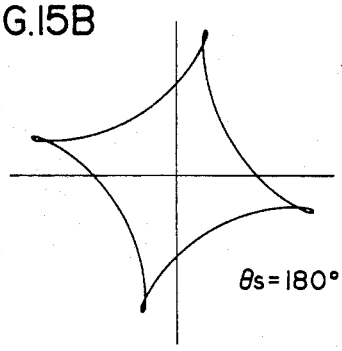
Figure 15E:
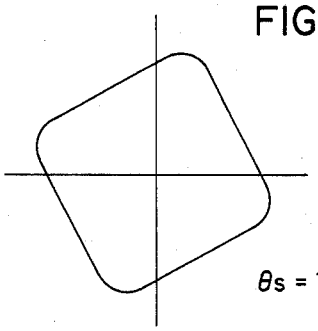
Figure 15C:
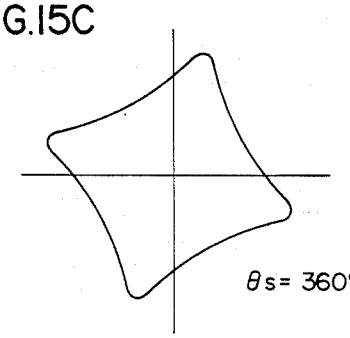

FIG. 14 shows a further embodiment of the pattern electrodes in the case where the present invention is applied to the UPF type of a SS camera tube shown in FIG. 2. In this embodiment, the leads $H_L+$, $H_L-$, $V_L+$ and $V_L-$ are spirally rotated over an angle of $\theta_s$ along the tube axis.

FIGS. 15A to 15E show the shapes of a beam spot on a paraxial image plane for every 180° of the rotation angle $\theta_s$ when undeflected. From these figures, it is seen that as the rotation angle $\theta_s$ increases, the spot shape has a change of four-leaf shape ($\theta_s=0°$)→asteroid ($\theta_s=180°$)→square ($\theta_s=360°$) and that as the angle further increases, the square becomes more rounded. Namely, it can be understood that the aberration of the octupole lens can be reduced even by rotating the deflection electrode leads spirally along the tube axis.

It is of course that the same effect can be obtained even if the spiral rotation of deflection electrode leads is applied to the BPF type of SS camera tube.

Figure 16:
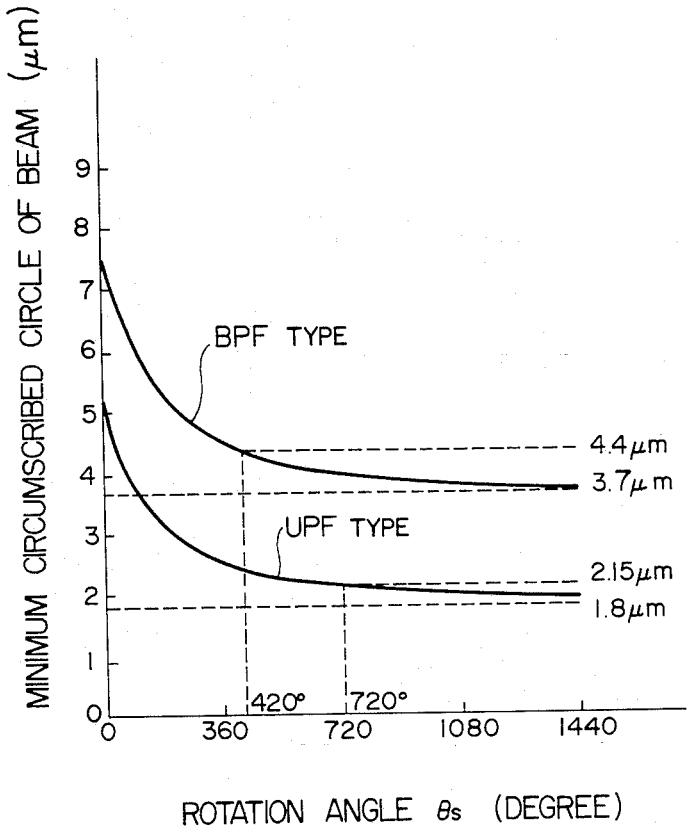
FIG. 16 shows a relationship between the diameter of the minimum circumscribed circle of the beam and a rotation angle $\theta_s$ for each of UPS and BPF type of SS camera tubes.

FIG. 16 shows the diameter of a circumscribed circle of a beam where the circle becomes minimum, for both UPF and BPF camera tubes. It is seen from this figure that as the rotation angle is increased, the beam diameter monotonically decreases, gradually approaching a certain asymptotic value (1.8 μm in the case of the UPF type and 3.7 μm in the case of the BPF type). If the increase of the beam diameter to the extent of 20% of the asymptotic value is tolerable, a suitable rotation angle $\theta_s$ is not smaller than 720° in the case of the UPF type of camera tube and not smaller than 420° in the case of the BPF type of camera tube.

As has been described above, the present inventin achieves the effects of minimizing the influence of the octupole lens formed by the lead portions of the deflection electrodes in the electron beam system of the SS camera tube to improve the resolution of the electron beam and reducing the dependency of the resolution on direction when a defocusing takes place.

We claim:

1. A cathode-ray tube comprising:

an electron beam generating means provided at one end of the tube for emitting an electron beam;

a target provided at the other end of the tube; and a group of electrodes provided on an inner wall of the tube for focusing and deflecting the electron beam emitted from said electron beam generating means, said electrode group including at least first and second electrode means toward the other end of the tube from the one end thereof in this order, said first electrode means having a lead portion for supplying an electric potential to said second electrode means, said lead portion extending along an axis of the tube with a zigzag form in which an angle ∠MZN of a concave apex M and a convex apex N adjacent thereto with reference to the tube axis Z as viewed from the side of said electron beam generating means is not smaller than 2. A cathode-ray tube according to claim 1, wherein said electrode group further includes a third electrode means behind said second electrode means.

3. A cathode-ray tube comprising:

an electron beam generating means provided at one end of the tube for emitting an electron beam;

a target provided at the other end of the tube; and a group of electrodes provided on an inner wall of the tube for focusing and deflecting the electron beam emitted from said electron beam generating means, said electrode group including at least first and second electrode means toward the other end of the tube from the one end thereof in this order, said first electrode means having a lead portion for supplying an electric potential to said second electrode means, said lead portion extending along an axis of the tube with a zigzag form in which an angle ∠MZN of a concave apex M and a convex apex N adjacent thereto with reference to the tube axis Z as viewed from the side of said electron beam generator means is within a range form 130° to 230°.

4. A cathode-ray tube according to claim 3, wherein said angle ∠MSN is integer times as large as about 180°.

5. A cathode-ray tube comprising:

an electron beam generating means provided at one end of the tube for emitting an electron beam;

a target provided at the other end of the tube; and a group of electrodes provided on an inner wall of the tube for focusing and deflecting the electron beam emitted from said electron beam generating section, said electrode group including at least first and second electrode means toward the other end of the tube from the one end thereof in this order, said first electrode means having a lead portion for supplying an electric potential to said second electrode means, said lead portion extending along an axis of the tube with a spiral form which rotates centering the tube axis, a rotation angle of said spiral form being not smaller than 420°.

6. A cathode-ray tube according to claim 5, wherein said electrode group further include a third electrode means behind said second electrode means.

7. A cathode-ray tube according to claim 6, wherein said rotation angle is not smaller than 720°.

* * * * *